US006530810B2

(12) United States Patent
Goodrich et al.

(10) Patent No.: US 6,530,810 B2
(45) Date of Patent: Mar. 11, 2003

(54) HIGH PERFORMANCE COMMUNICATION CONNECTOR CONSTRUCTION

(75) Inventors: Robert Ray Goodrich, Indianapolis, IN (US); Paul J. Straub, Jr., Mooresville, IN (US); William C. Ziegler, Cicero, IN (US); Cherie L. Wolfe, Greenwood, IN (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/815,118

(22) Filed: Mar. 22, 2001

(65) Prior Publication Data

US 2002/0055302 A1 May 9, 2002

Related U.S. Application Data

(63) Continuation-in-part of application No. 09/664,814, filed on Sep. 19, 2000.

(51) Int. Cl.[7] ..... H01R 24/00
(52) U.S. Cl. ..... 439/676; 439/941
(58) Field of Search ..... 439/941, 344, 439/676

(56) References Cited

U.S. PATENT DOCUMENTS 4,556,264 A * 12/1985 Tanaka ..... 439/676
4,904,209 A * 2/1990 Nelson ..... 439/676
4,975,078 A * 12/1990 Stroede et al. ..... 439/676
5,791,943 A * 8/1998 Lo et al. ..... 439/676
5,885,111 A 3/1999 Yu ..... 439/676
5,924,896 A 7/1999 Arnett et al. ..... 439/676
6,116,964 A 9/2000 Goodrich et al. ..... 439/676
6,135,821 A * 10/2000 Liu ..... 439/676
6,224,427 B1 5/2001 Goodrich ..... 439/676

* cited by examiner

*Primary Examiner*—Tho D. Ta
*Assistant Examiner*—Ross Gushi

(57) ABSTRACT

A communication connector capable of sustaining Category 6 performance when subjected to physical stress in an operating environment. The connector includes a connector housing, and a wire board with contact wires extending over a top surface of the board to establish points of electrical contact with terminals of a mating connector when the latter is inserted in the connector housing. A terminal housing is fixed on the top surface of the wire board, for supporting a number of connector terminals which are mounted on the board. The terminal housing and the connector housing are constructed and arranged to engage one another when the wire board is inserted with its contact wires in the connector housing, so that displacement of the points of contact between the contact wires and the terminals of the mating connector, is restrained during use of the communication connector.

5 Claims, 10 Drawing Sheets

HIGH PERFORMANCE COMMUNICATION CONNECTOR CONSTRUCTION

CROSS-REFERENCE TO RELATED APPLICATION

This application is a continuation-in-part of co-pending U.S. application Ser. No. 09/664,814 filed Sep. 19, 2000, entitled "Low Crosstalk Communication Connector". The '814 application is assigned to the assignee of the present application and invention.

BACKGROUND OF THE INVENTION

1. Field of the Invention

This invention relates to a high frequency communication connector that is constructed so as to minimize variation in electrical performance when in use.

2. Discussion of the Known Art

Many factors contribute to variations in electrical performance of a high frequency communication connector. For example, dimensional tolerances specified for various parts of the connector, and for the assembly of the parts to one another during production, can combine to produce such performance variations. It is therefore desirable to reduce as much as possible the effects of such manufacturing tolerances, so that operation of the connector is enhanced and a high level of performance is sustained.

There is also a need for a durable, high-frequency communication connector that compensates for (i.e., cancels or reduces) crosstalk among different signal paths through the connector. As defined herein, crosstalk occurs when signals conducted over a first path, e.g., a pair of terminal contact wires associated with a communication connector, are partly transferred by inductive or capacitive coupling into a second path, e.g., another pair of terminal contact wires in the same connector. The transferred signals produce "crosstalk" in the second path, and such crosstalk degrades existing signals routed over the second path.

Applicable industry standards for rating the degree to which communication connectors exhibit crosstalk, do so in terms of near-end crosstalk or "NEXT". These ratings are typically specified for mated plug and jack combinations, wherein input terminals on the plug connector are used as a reference plane. Communication links using unshielded twisted pairs (UTP) of copper wire are now expected to support data rates up to not only 100 MHZ or industry standard "Category 5" performance, but to meet or exceed "Category 6" performance levels which call for at least 46 dB crosstalk loss at 250 MHZ.

U.S. Pat. No. 5,924,896 (Jul. 20, 1999), which is assigned to the assignee of the present invention and application, discloses a high frequency communication jack connector including a printed wire board from which a number of spring contact wires or "jackwires" extend to connect with corresponding terminals of a mating plug connector. Specifically, a rear portion of the wire board is sandwiched between a terminal housing that surrounds and supports two rows of insulation displacement connector (IDC) terminals that are mounted on the top surface of the board, and a lower cover which protects the bottom surface of the board. The cover is joined to a post that extends from beneath the terminal housing and through a corresponding hole in the wire board.

The sub-assembly comprising the joined terminal housing, wire board and lower cover are then fastened as a unit to a jack frame of the connector. Specifically, a front portion of the wire board is inserted in a rear cavity in the jack frame. A latch, which protrudes from the jack frame below the rear cavity, engages a shoulder that is formed at a front edge of the cover below the wire board, thus tending to restrain separation between the jack frame and the sub-assembly in a direction parallel to the wire board.

U.S. Pat. No. 6,116,964 (Sep. 12, 2000), which is also assigned to the assignee of the present invention and application, discloses a communication jack connector having co-planar contact wires that are spaced a certain distance above a wire board. Base portions of the wires are mounted on the board, and certain pairs of the wires have opposed cross-over sections formed near a line of contact between the wires and a mating connector. A coupling region along the wires beyond the cross-over sections compensates for crosstalk introduced by the mating connector. In an arrangement similar to that in the '896 patent, a sub-assembly is produced wherein a rear portion of the wire board is captured between a terminal housing that surrounds IDC terminals mounted on top of the board, and a lower cover on the bottom surface of the board which is joined to a post extending from the terminal housing. The front of the wire board is inserted in a rear passage in the jack frame, and a latch on the jack frame engages a flange on the lower cover, thus attaching the jack frame and the sub-assembly to one another.

Under certain operating conditions, for example, when outside wire leads are terminated at the IDC terminals within the rear terminal housing, and the leads are dressed inside a wall box or a rack on which the jack frame is mounted, forces may be applied to the connector such as to cause the terminal housing and the wire board to pivot away from the jack frame. Such movement can cause the point of contact between the contact wires of the wire board and the terminals of the plug connector to be displaced from a specified design point, and the electrical performance of the mated connectors will vary accordingly.

A communication connector which can sustain crosstalk compensation meeting Category 6 performance while being subjected to various physical stresses during operation, is therefore very desirable in modern telecommunications environments.

SUMMARY OF THE INVENTION

According to the invention, a communication connector includes a connector housing having a front face with a connector opening for receiving a mating connector, and a rear wall. A wire board has a number of contact wires extending above a top surface of the board to establish points of electrical contact with corresponding contact terminals of the mating connector, when the mating connector is received in the opening in the connector housing. A terminal housing is fixed on the top surface of the wire board for supporting associated connector terminals mounted on the wire board, and the terminal housing and the connector housing are constructed and arranged to engage one another when a portion of the wire board and associated contact wires are inserted in the connector housing, thus restraining displacement of the points of electrical contact between the contact wires of the wire board and the contact terminals of the mating connector.

For a better understanding of the invention, reference is made to the following description taken in conjunction with the accompanying drawing and the appended claims.

DETAILED DESCRIPTION OF THE INVENTION

Figure 1:
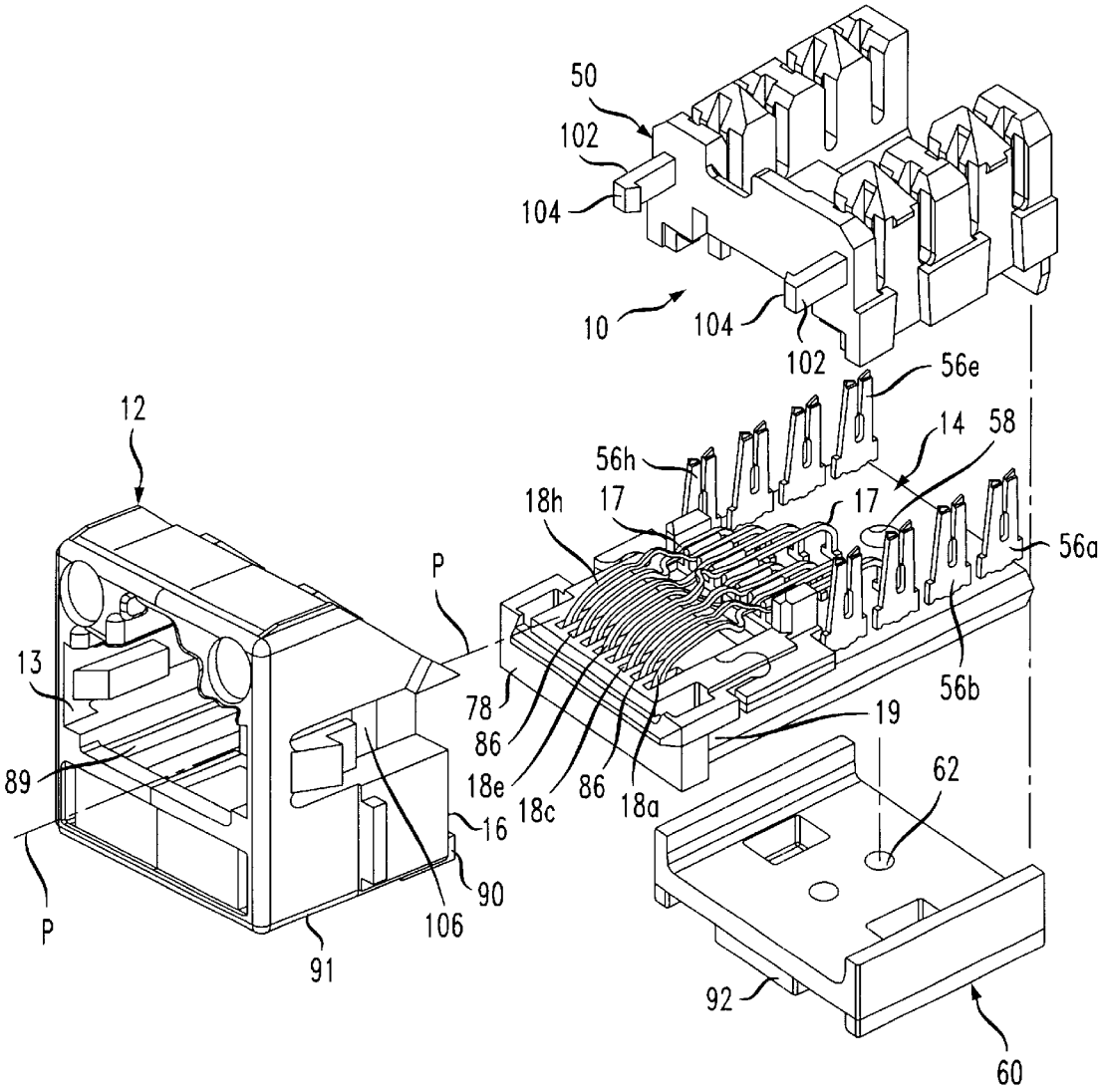
FIG. 1 is an assembly view of a communication connector according to the invention.

FIG. 1 is an assembly view of a communication connector 10 according to the invention. The connector 10 includes a jack housing 12 having a front face in which a plug opening 13 is formed, and a rear wall 16. The plug opening 13 has an axis P along the direction of which a mating plug connector 11 (see FIGS. 5 and 12) is insertable into the jack housing.

The communication connector 10 also includes a generally rectangular printed wire board 14. For example, the board 14 may comprise a single or a multi-layer dielectric substrate. A number of elongated terminal contact wires 18*a*–18*h* extend in a generally horizontal direction with respect to a top surface of the wire board 14, and substantially parallel to one another. Connecting portions 17 of the contact wires are spaced a certain distance (e.g., 0.090 inches) from the top surface of the wire board 14.

Figure 2:
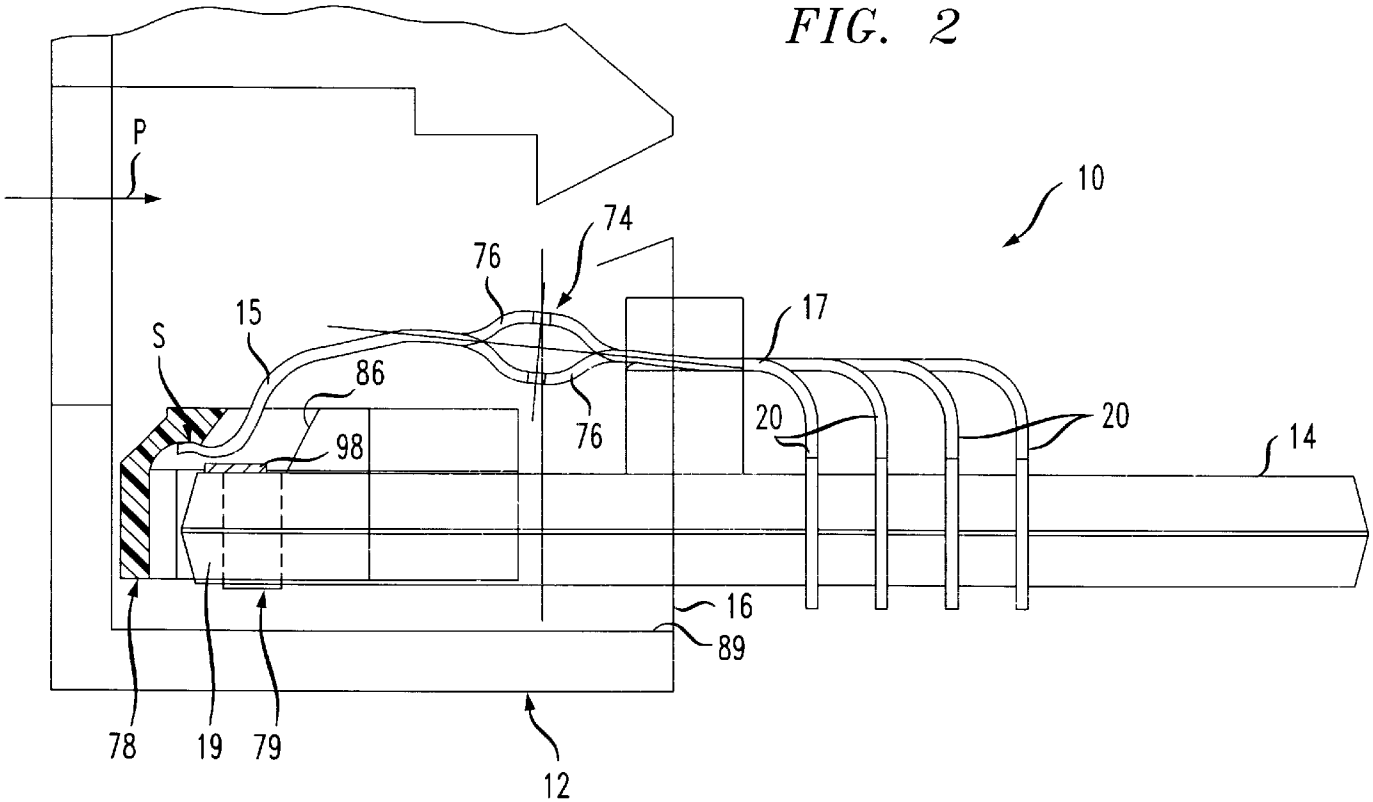
FIG. 2 is an enlarged, side view of a wire board in the connector of FIG. 1, and contact wires on the board at a first position out of engagement with compensation coupling contacts at a front edge region of the board.

As seen in FIG. 2, free ends 15 of the connecting portions 17 curve downward toward a front edge region 19 of the wire board 14. The free ends 15 are formed to deflect resiliently in the direction of the front edge region 19 of the board when blade contact terminals 21 (shown in FIG. 5) of the plug connector 11 wipe over the connecting portions 17 of the contact wires 18*a*–18*h* in a direction parallel to the top surface of the board (i.e., along the axis P). See FIG. 3. The terminal contact wires 18*a*–18*h* may be formed of a copper alloy such as spring-tempered phosphor bronze, beryllium copper, or the like. A typical cross-section of the contact wires is 0.015 inch wide by 0.010 inch thick.

Terminal contact wires 18*a*–18*h* have associated base portions 20 opposite the free ends 15. Each base portion 20 is formed to connect a contact wire to one or more conductors (not shown) on or within the wire board 14. For example, the base portions 20 may be soldered or press-fit in plated terminal openings formed in the board, to connect with corresponding conductive paths on or within the board. As shown in the drawing, the base portions 20 project in a generally normal direction with respect to the top surface of the wire board 14.

In the disclosed embodiment, the base portions 20 are shown as entering the wire board 14 with a "duo-diagonal" footprint pattern. Alternatively, the base portions may enter the wire board with other footprints, e.g., a "saw tooth" pattern, as long as there is sufficient spacing between the plated openings that receive the base portions to avoid electrical arcing, per industry requirements.

The wire board 14 may incorporate electrical circuit components or devices arranged on or within portions of the board, to compensate for connector-induced crosstalk. Such devices include but are not limited to wire traces printed on or within layers of the board 14, as disclosed in U.S. Pat. No. 5,997,358 (Dec. 7, 1999) all relevant portions of which are incorporated by reference.

An electrically insulative, dielectric terminal housing 50 (FIG. 1) covers a rear portion of the top surface of wire board 14. Outside insulated wire leads may be connected to insulation displacement connector (IDC) terminals 56*a* to 56*h* that are mounted on the board, which terminals are partly surrounded and supported by housing terminal guards. The housing 50 is formed of a plastics or other insulative material that meets all applicable standards with respect to electrical insulation and flammability. Such materials include but are not limited to polycarbonate, ABS, and blends thereof. The housing 50 has, for example, at least one fastening or mounting post (not shown) that projects from a bottom surface of the housing to pass through one or more openings 58 formed along the long axis of the board 14.

Terminals 56*a*–56*h* are mounted along both sides of the rear portion of the wire board 14, as seen in FIG. 1. Each of the terminals 56*a*–56*h* has a mounting portion that is soldered or press fit in a corresponding terminal mounting hole in the board, to connect via a conductive path (not shown) with a corresponding one of the terminal contact wires 18*a*–18*h*. When the terminal housing 50 is aligned above the IDC terminals 56*a*–56*h*, and then lowered to receive the terminals in corresponding slots in the terminal guards, a fastening post of the housing 50 aligns with and passes through an opening 58 in the board 14.

A cover 60 is formed of the same or a similar material as the terminal housing 50. The cover 60 is arranged to protect the rear portion of the wire board 14 on the bottom surface of the board. Cover 60 has at least one opening 62 which aligns with a tip of a fastening post of the housing 50 extending through the opening 58 in the wire board. The rear portion of the board is thus captured and secured between the terminal housing 50 and the cover 60, and the tip of the fastening post is joined to the body of the cover 60 by, e.g., ultrasonic welding, so that the rear portion of the wire board is protectively enclosed. See U.S. Pat. No. 5,924,896 (Jul. 20, 1999), all relevant portions of which are incorporated by reference.

Figure 4:
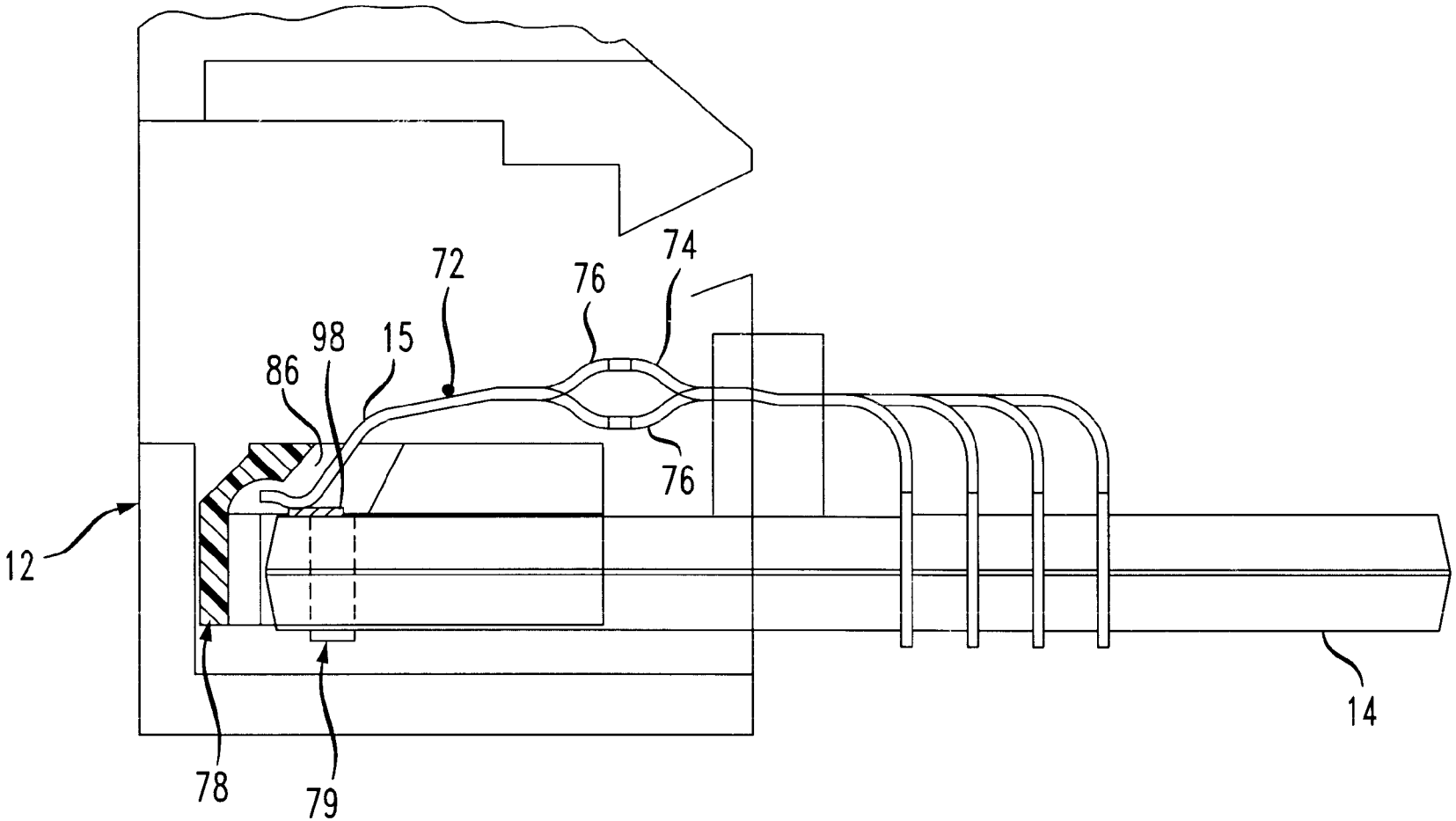
FIG. 4 is a side view as in FIG. 2, showing the contact wires at a second position in engagement with the compensation coupling contacts at the front of the wire board.
Figure 5:
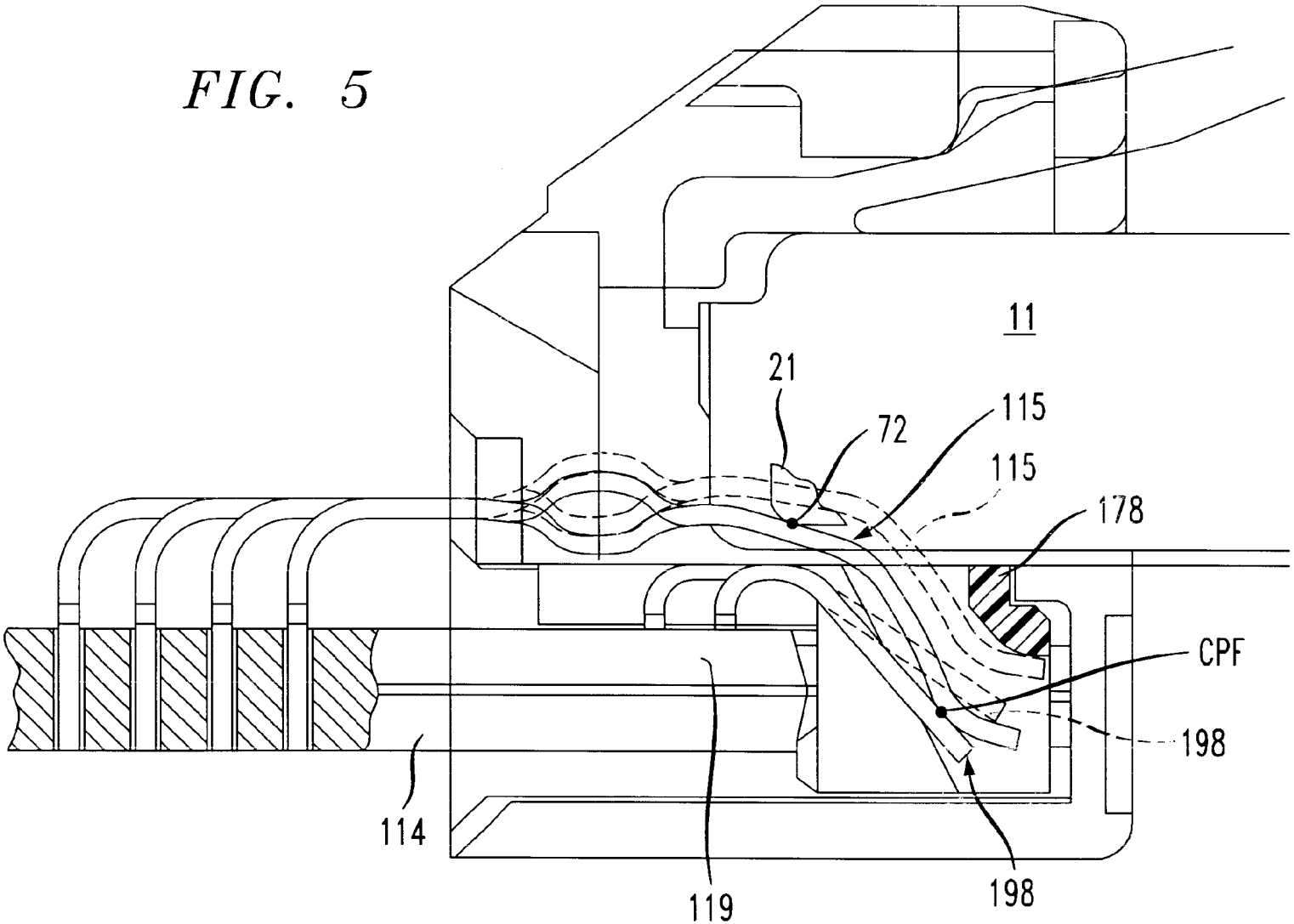
FIG. 5 is a side view of a second embodiment of a communication connector according to the invention.

The connecting portions 17 of the terminal contact wires, between the base portions 20 and the free ends 15 of the wires, are formed to make electrical contact with corresponding blade contact terminals 21 of the plug connector 11 (see, e.g., FIG. 5). A line of contact 72 (see FIGS. 4 & 5) is defined transversely of the contact wires, along which points of electrical contact are established between the connector 10 and the blade contact terminals 21 of the plug connector 11. As mentioned, when the plug connector 11 is inserted in the opening 13 of the jack housing 12, the free ends 15 of contact wires 18*a*–18*h* are deflected in unison toward the front edge region 19 of the wire board 14.

Certain pairs of the terminal contact wires have cross-over sections 74 at which one contact wire of a pair is stepped toward and crosses over the other contact wire of the pair, with a generally "S"-shaped side-wise step 76. As seen in FIGS. 2 and 4, the terminal contact wires curve arcuately above and below their common plane at each cross-over section 74. Opposing faces of the steps 76 in the contact wires are typically spaced by about 0.040 inches to prevent shorting when the terminal wires are engaged by the mating connector 11.

The cross-over sections 74 are relatively close to the line of contact 72, and serve to allow inductive crosstalk compensation coupling to be induced among parallel portions of the terminal contact wires in a region between the cross-over sections 74 and the base portions 20 of the contact wires.

A terminal wire guide block 78 is mounted on the front edge region 19 of the wire board 14, as shown in FIGS. 1, 2 and 4. The guide block 78 has equi-spaced vertical guide ways 86. The free ends 15 of the terminal contact wires extend within corresponding ones of the guide ways, and are guided individually for vertical movement when deflected by the blade contact terminals 21 of the plug connector 11, as in FIG. 4. Each guide way 86 is, e.g., 0.020 inch wide, and 0.020 inch thick walls separate adjacent ones of the guide ways. The guide block 78 may also have, e.g., ribbed mounting posts 79 that project downward to register with corresponding mounting holes in the wire board 14 to establish a press-fit.

When in the undeflected position of FIG. 2, the free ends 15 of the terminal contact wires abut an upper inside surface of each guideway 86. A determined pre-load force is thus established, to be applied by the blade contact terminals 21 of the plug connector 11 as the former wipe against and urge the free ends 15 of the contact wires downward to the position of FIG. 4.

As they deflect downward, the free ends 15 of the contact wires themselves establish a wiping contact against corresponding compensation coupling contacts in the form of conductive contact pads 98. See FIGS. 2 & 3. The pads 98 are arrayed in a row parallel to and near the front edge of the wire board, and are spaced apart from one another by a distance corresponding to a spacing between the free ends 15 of the terminal contact wires. The guideways 86 of the block 78 serve to keep the free ends 15 aligned and centered with corresponding ones of the contact pads 98 on the wire board.

The contact pads 98 are connected by conductive paths to, e.g., capacitive crosstalk compensation elements on or within the wire board 14. Accordingly, when the terminal contact wires are engaged by a mating connector, certain pairs of contact wires will be capacitively coupled to one another by compensation elements connected to the corresponding contact pads 98. Note that the free ends 15 are ahead of and near the line of contact 72 with the mating connector. Crosstalk compensation coupling is thus introduced onto non-current carrying portions of the contact wires, and operates at the connector interface (i.e., the line of contact 72) where such coupling can be most effective.

Figure 3:
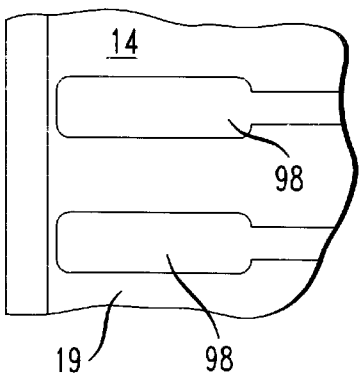
FIG. 3 is an enlarged plan view of two compensation coupling contacts in the form of pads at the front edge region of the wire board in FIG. 2.

FIG. 3 is an enlarged view of two adjacent contact pads 98. Each pad is typically, e.g., 0.018 inches wide, and side edges of the pads are typically spaced apart from one another by, e.g., 0.022 inches to meet a specified 1000 volt breakdown requirement. Corners of the contact pads 98 are preferably rounded with a radius of, e.g., 0.004 inches.

Crosstalk compensation elements or devices that are coupled to the contact pads 98 are provided in a region 100 on or within the wire board 14, in the vicinity of the pads 98 at the front edge region 19 of the wire board 14. See FIG. 9. Compensation elements within the region 100 preferably are not part of any other capacitive or inductive compensation circuitry that may be incorporated at other portions (e.g., toward the rear) of the board 14. Placing the compensation elements close to the associated contact pads 98 enhances the effect of such elements at the connector interface.

The wire board 14 including the front edge region 19 with the array of contact pads 98, may be supported within space available in existing jack frames such as, e.g., jack frames provided with the type "MGS 300" series of modular connectors available from Avaya Inc.

The wire board 14 with the guide block 78 mounted at front edge region 19, is inserted in a passage 89 that opens in the rear wall 16 of the jack housing 12. See FIGS. 1 & 2. Side edges of the board 14 are guided for entry into the housing 12 by, e.g., flanges that project from inside walls of the jack housing 12. The jack housing has a slotted catch bar 90 (FIG. 1) protruding rearwardly from a bottom wall 91 of the housing. The bar 90 is arranged to capture a lip 92 that projects downward beneath the wire board cover 60. When the wire board 14 is inserted in the jack housing 12, the top surface of the board is parallel to the plug opening axis P along the direction of which the plug connector 11 may engage and disengage the free ends 15 of the contact wires 18*a*–18*h*.

Further, in the present embodiment, two side catches 102 project forward from both sides of the terminal housing 50, and the catches 102 have hooked ends 104 that snap into and lock within recesses 106 formed in both side walls of the jack housing 12. Thus, all adjoining parts of the connector 10 are positively attached to one another to reduce movement between them, and to maintain rated connector performance by reducing variation in relative positions of the connector parts when finally assembled.

Figure 6:
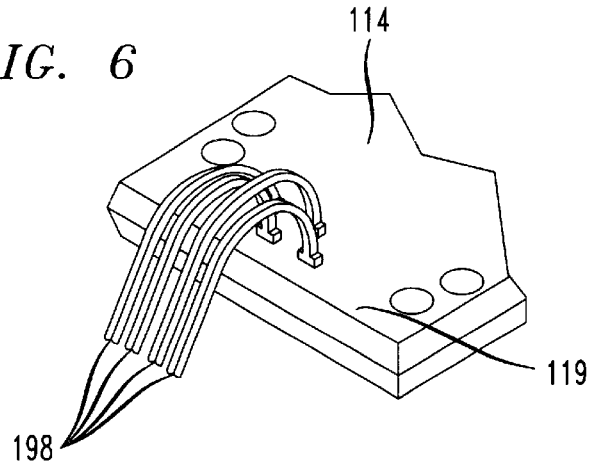
FIG. 6 is a perspective view of a front edge region of a wire board in the embodiment of FIG. 5, showing compensation coupling contacts in the form of stiff wires mounted on the board.

FIGS. 5 and 6 show a front edge region 119 of a wire board 114 in a second embodiment of a connector assembly according to the invention. In the second embodiment, free ends 115 of the terminal contact wires project forward beyond the front edge region 119 of the board 114. A number of arcuate, stiff wire contacts 198 are mounted at the front edge region 119, and are aligned beneath corresponding free ends 115 of the contact wires.

FIG. 5 shows, in dotted lines, the position of the free ends 115 of the terminal contact wires in a pre-loaded state, resting against upper ledges in the guide ways of a guide block 178 mounted on the wire board 114. FIG. 5 also shows an initial position of the contacts 198 in dotted lines. When the mating plug connector 11 is received in the jack frame, the free ends 115 of the terminal contact wires deflect resiliently downward. The wire contacts 198 mounted on the board are then engaged by the free ends of those terminal contact wires aligned above them, as shown in solid lines in FIG. 5. Like the first embodiment, this arrangement introduces crosstalk compensation coupling via associated compensation elements disposed near the wire contacts 198, on or within the wire board 114.

Figure 7:
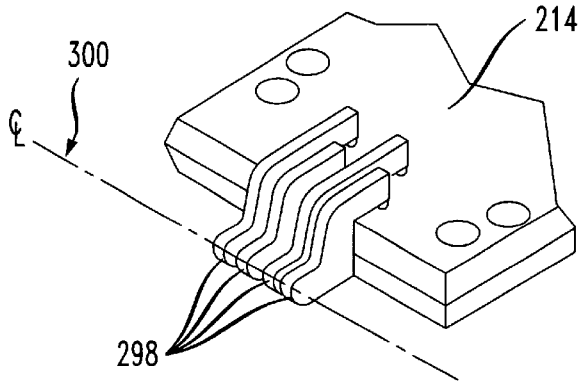
FIG. 7 is a perspective view of a front edge region of a wire board in a third embodiment of communication connector according to the invention, showing compensation coupling contacts in the form of metal plates mounted on the wire board.
Figure 8:
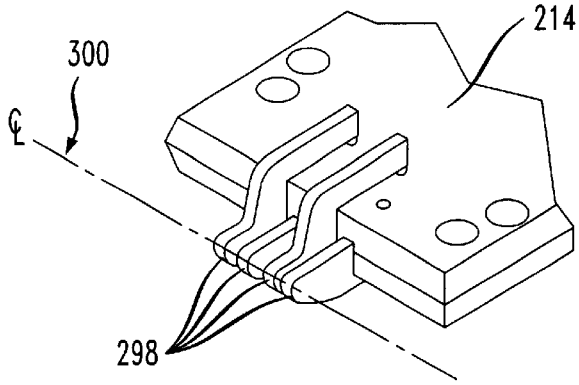
FIG. 8 shows an alternate arrangement of the metal plate contacts on the wire board in FIG. 7.

FIGS. 7 and 8 show a third embodiment wherein compensation coupling contacts 298 are in the form of noncompliant conductive members, e.g., stamped metal plates. The metal plates may have, for example, compliant "needle-eye" mounting bases (not shown) dimensioned and formed to be press-fit into corresponding plated terminal openings in an associated wire board 214. As the free ends of the terminal contact wires deflect downward, they make contact with corresponding ones of the metal plates along a contact line 300. FIG. 8 shows an arrangement wherein the mounting bases of adjacent metal plates 298 enter the wire board 214 from opposite sides of the board, thus reducing potential offending crosstalk that might otherwise be induced among the plates 298.

Figure 9:
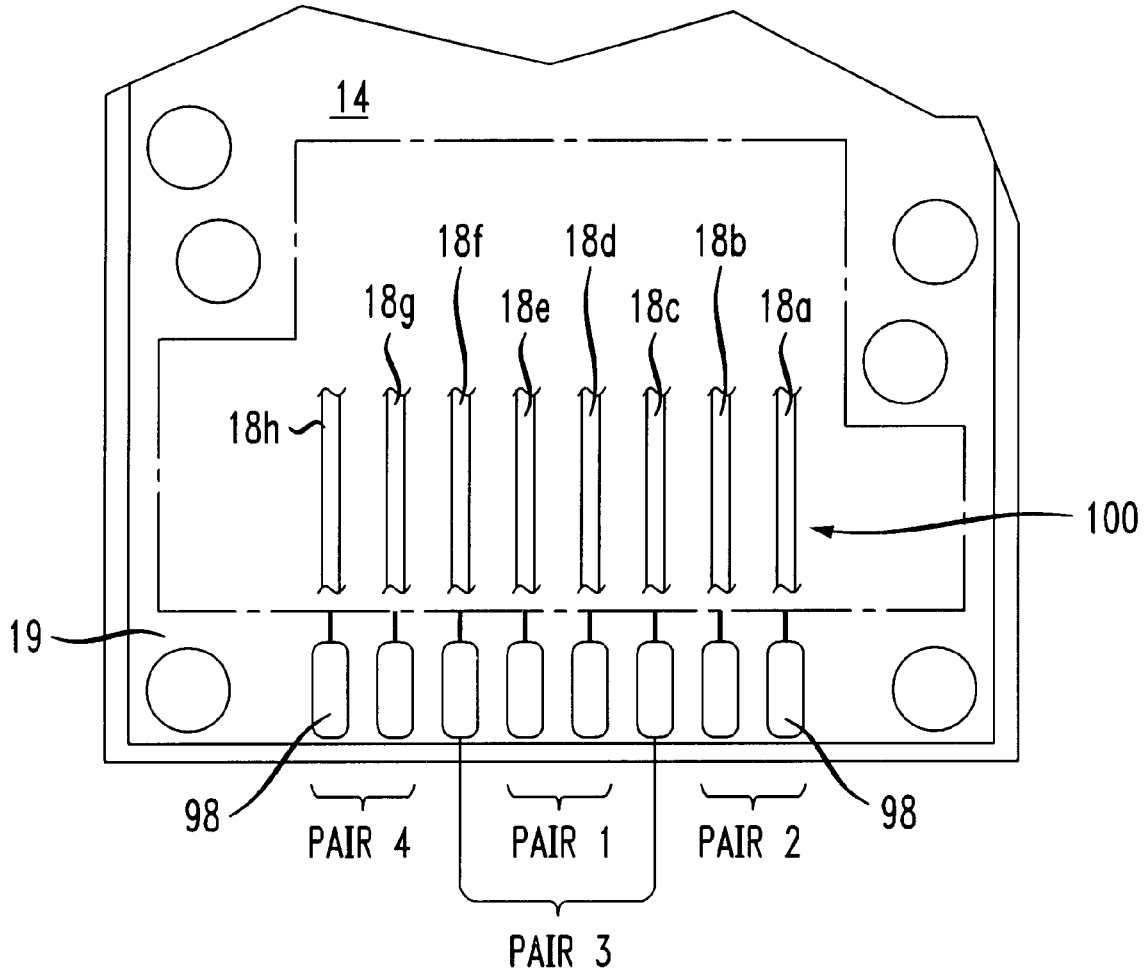
FIG. 9 is a plan view of the front edge region of the wire board in the embodiment of FIGS. 1–4.

FIG. 9 is a view of the front edge region 19 of the wire board 14 in the embodiment of FIGS. 1-4, showing eight contact pads 98. Each of the pads is disposed on the board 14 in operative relation beneath a free end of an associated terminal contact wire. Capacitive compensation coupling was introduced between pairs of the pads by way of wire traces or elements embedded within the region 100 on the board 14, as detailed later below. The rightmost pad 98 in FIG. 9 is associated with contact wire 18*a* in FIG. 1, and the leftmost pad in the figure is associated with contact wire 18*h*. Four pairs of the eight contact wires define four different signal paths in the connector 10, and the signal-carrying pairs of contact wires are identified by number as follows with reference to FIG. 9.

| PAIR NO. | CONTACT WIRES |
|---|---|
| 1 | 18d and 18e |
| 2 | 18a and 18b |
| 3 | 18c and 18f |
| 4 | 18g and 18h |

Values of capacitive compensation coupling introduced via the pads 98 associated with the contact wires, were as follows.

| Pads 98 associated with contact wires | Capacitance (picofarads) between pads 98 |
|---|---|
| 18a and 18c | 0.04 |
| 18a and 18d | 0.04 |
| 18b and 18e | 0.09 |
| 18b and 18f | 0.42 |
| 18c and 18e | 1.25 |
| 18d and 18f | 1.25 |

NEXT measurements were performed with the above values of capacitive coupling introduced via the pads 98 between the free ends of the contact wires. Some crosstalk compensation was also provided in a region of the wire board 14 outside the region 100. Category 6 performance was met or exceeded among all four signal-carrying pairs of the contact wires in the connector 10.

Figure 10A:
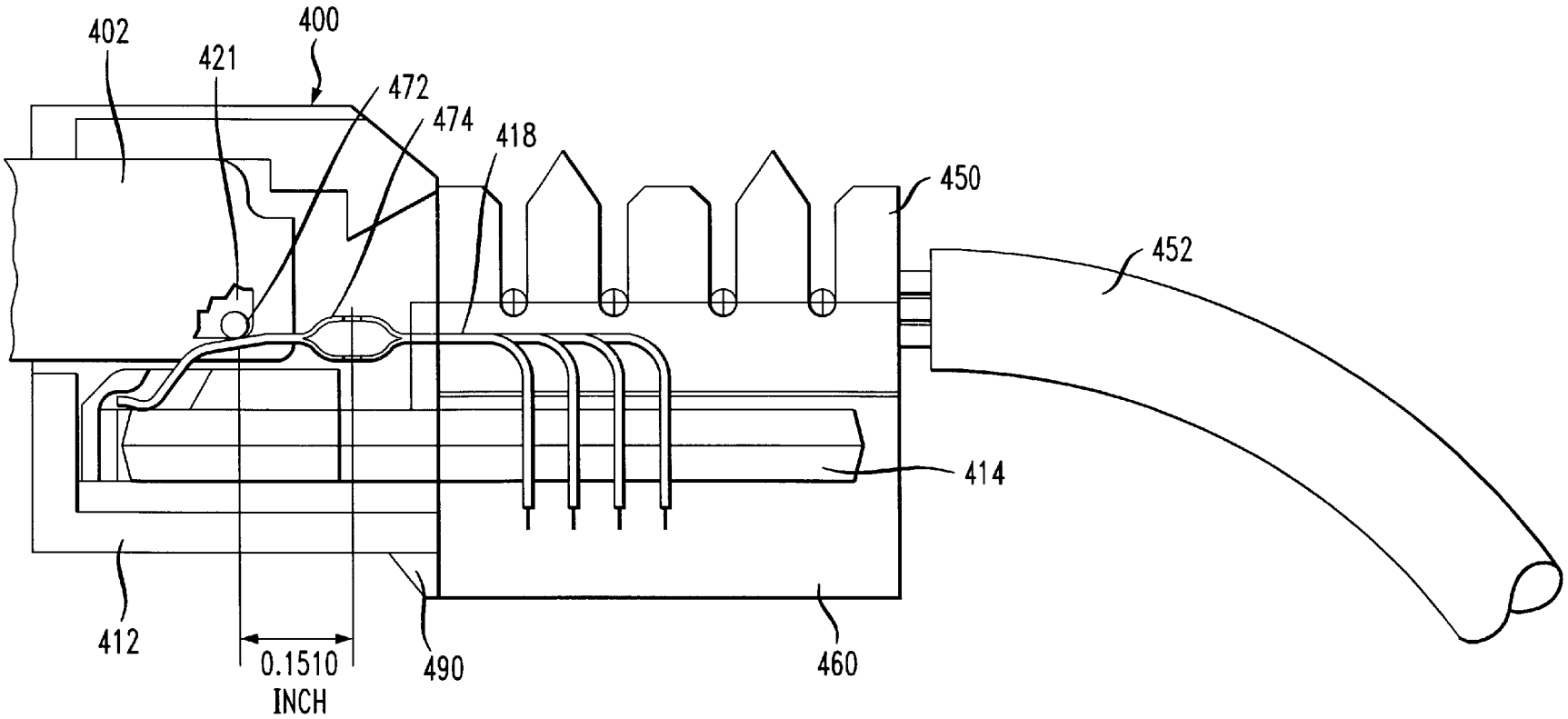
FIGS. 10*a* and 10*b* show a typical communication jack connector wherein a force is applied to a terminal housing by outside wire leads at the rear of the jack connector.
Figure 10B:
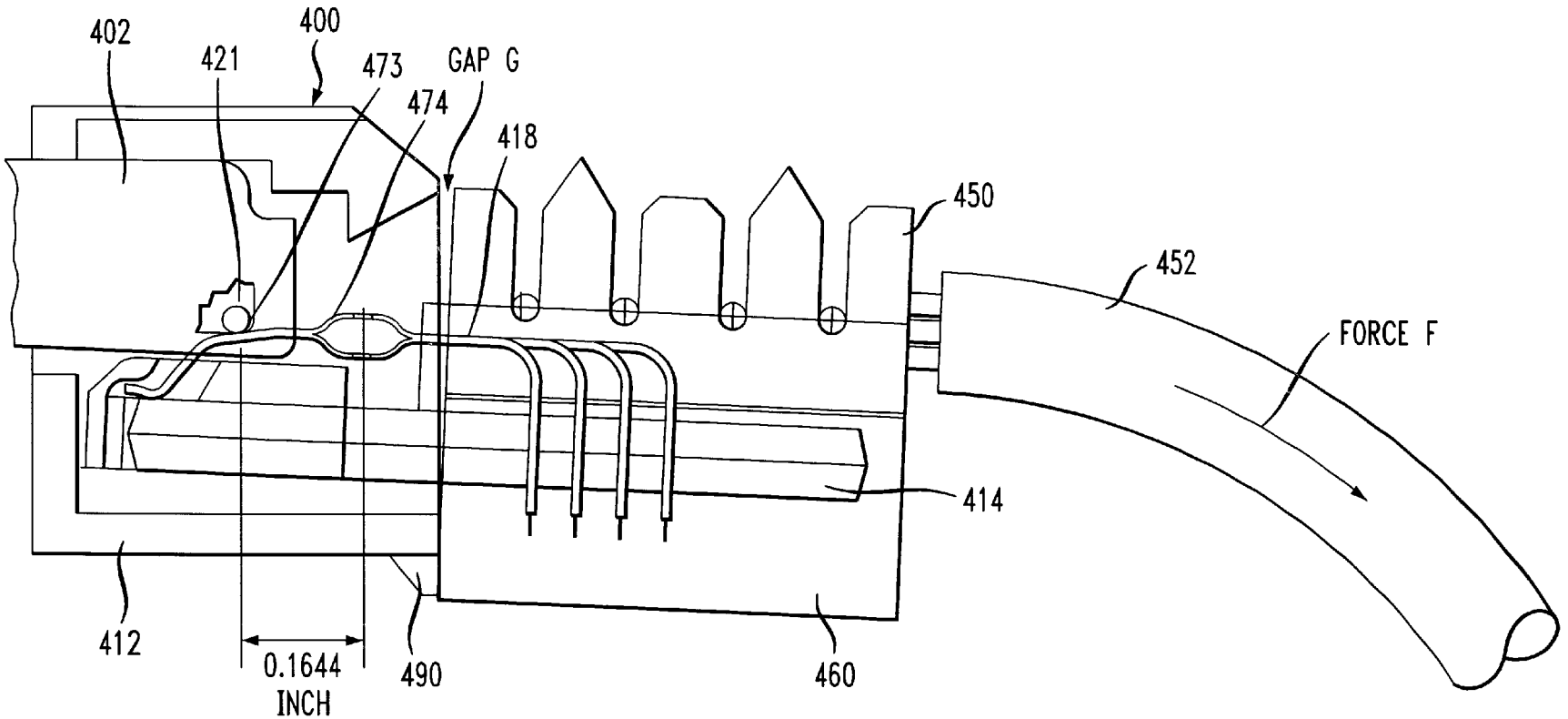

FIGS. 10*a* and 10*b* show a typical communication jack connector 400, and a mating plug connector 402 which is received and engaged in a jack frame 412 of the connector 400. A rear portion of a wire board 414 is sandwiched as part of a sub-assembly between a terminal housing 450, and a lower cover 460 to which the terminal housing is joined. A part of the lower cover 460 is engaged by a lower latch or catch bar 490 that protrudes from the rear of the jack frame 412. A number of terminal contact wires 418 mounted on the wire board extend into the jack frame 412, so as to establish points of electrical contact with corresponding contact terminals 421 of the plug connector 402. Outside leads 452 are terminated in IDC terminals supported by the terminal housing 450, at the rear of the connector 400.

If the connector 400 lacks connection means equivalent to the catches 102 and corresponding recesses 106 associated with the terminal housing 50 and the connector or jack housing 12 of the present connector 10, the jack frame 412 of the connector 400 will tend to pivot apart from the terminal housing 450 when a pull force F is applied to the outside leads 452, as shown in FIG. 10*b*. Specifically, a gap G will develop between upper regions of the jack frame 412 and the terminal housing 450. When the jack frame 412 is made to separate from the terminal housing 450 as shown in FIG. 10*b*, the point of contact between the contact wires 418 of the jack connector 400 and the contact terminals 421 of the plug connector 402, will deviate from a specified design point of contact 472 shown in FIG. 10*a*, to a displaced point of contact 473 in FIG. 10*b*. As shown in FIGS. 10*a* and 10*b*, the distance between compensation cross-over sections 474 on the contact wires and the displaced point of contact 473 may increase from a design specification of 0.1510 inch, to 0.1644 inch. This represents an increase of 0.0134 inch or nine percent, and the electrical performance of the mated connectors 400, 402 will change accordingly.

Figure 11:
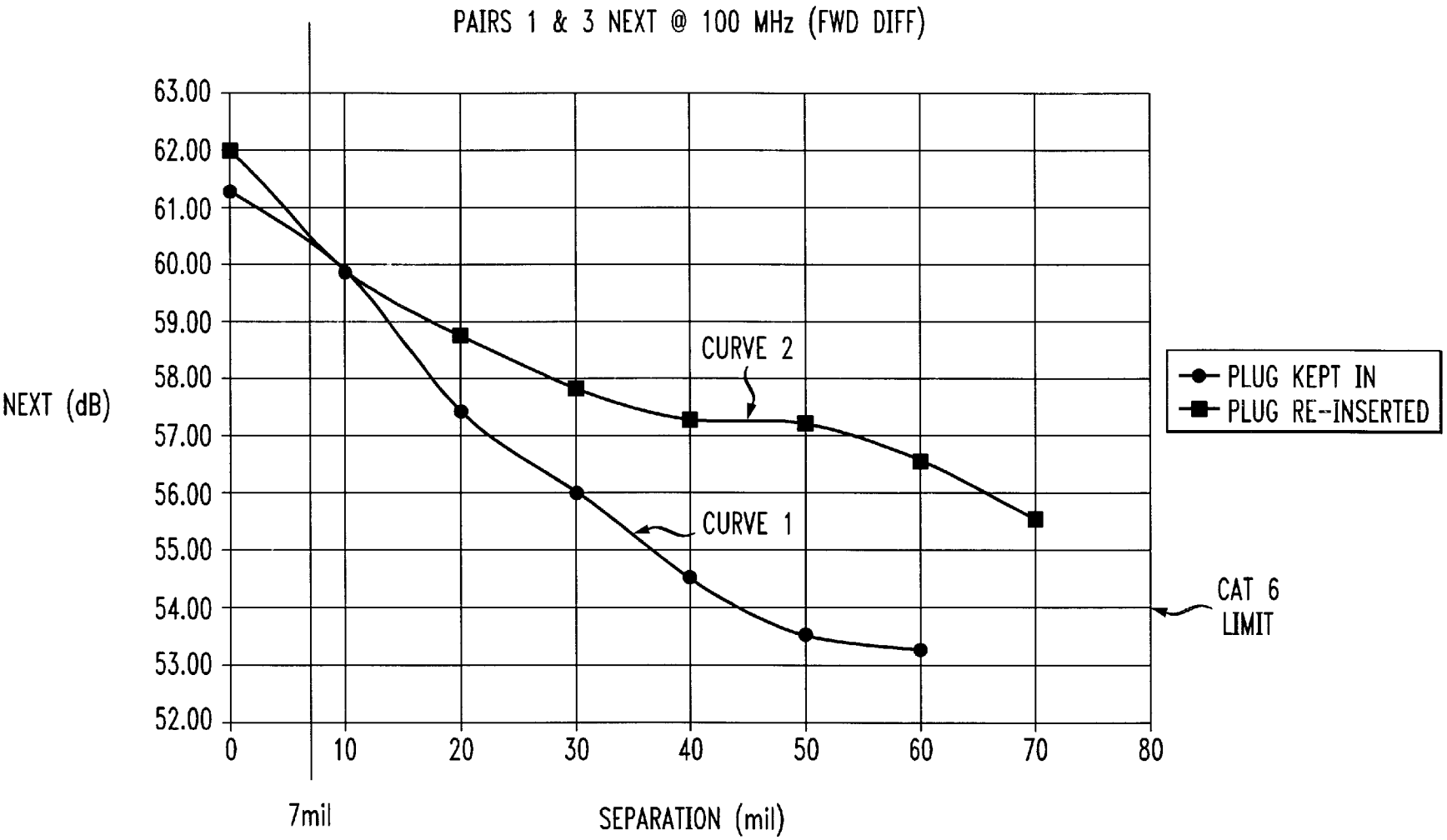
FIG. 11 is a graph showing near-end crosstalk (NEXT) performance of the mated connectors in FIG. 10.

FIG. 11 is a plot of test data demonstrating the effectiveness of the catches 102 in the present connector 10 toward reducing electrical performance variation. Assume that without the catches 102 (1.e., the condition in FIGS. 10*a* and 10*b*), the gap G may vary between zero and 30 mils (0.000 inch to 0.030 inch) in typical operating environments. Curve 1 shows that the degradation in near end cross talk (NEXT) performance as gap G varies from zero to 30 mils, is from 61.3 dB to 56.0 dB if the plug 402 remains inserted in the jack housing 412 while the outside leads 452 are pulled to vary the gap G. Curve 2 in FIG. 11 shows that the degradation in NEXT performance as the gap G varies from zero to 30 mils, is from 62.0 dB to 57.8 dB if the plug 402 is removed and re-inserted prior to the performance measurement for each gap setting.

FIG. 11 also shows that if the gap G is limited to not more than about 7 mils (0.007 inch), such as by the provision of the two catches 102 and corresponding recesses 106 in the present connector 10, a minimum NEXT loss of 60 dB among the pair 1 and the pair 3 contact wires is obtained which is well within Category 6 performance limits. As seen in FIG. 11, by limiting the maximum gap G to 0.007 inch, further degradation in the electrical performance of the mated connectors 400, 402 by as much as 4.4 dB at 100 MHZ, is avoided. See Curve 1 for a separation gap G of 30 mils.

Figure 12:
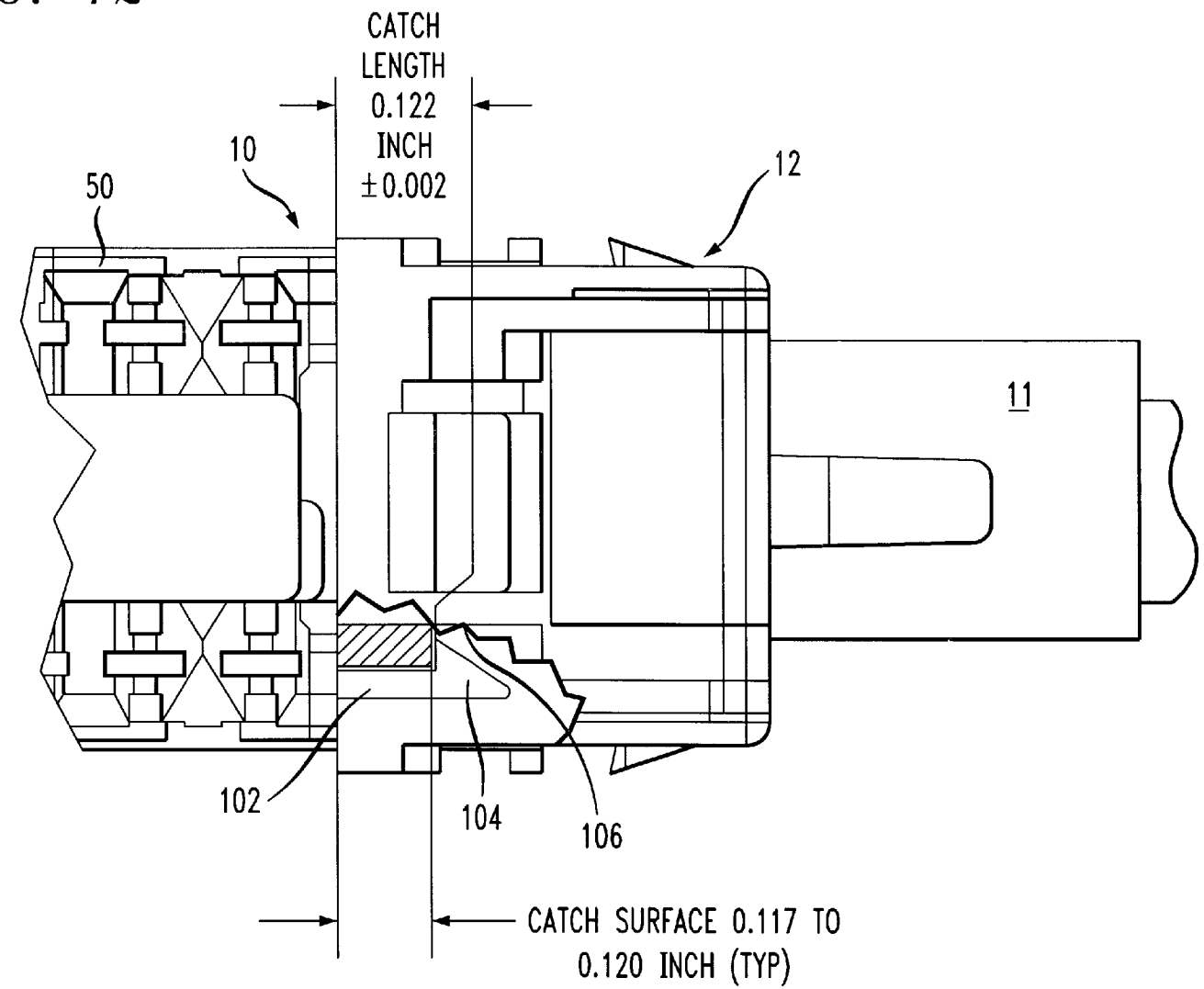
FIG. 12 is a top view, partly in section, of the present connector and a mating plug connector.

FIG. 12 shows an example of dimensional tolerances for the jack housing 12 and the catches 102 on the terminal housing 50 of the present connector 10. These tolerances will limit the gap G to between zero and 7 mils. Specifically, the length of each of the catch surfaces between the rear wall 16 of the jack housing 12 and the recesses 106 into which the hooked ends 104 of the catches 102 snap, is specified at, e.g., 0.117 to 0.120 inch. The length of each catch 102 between the front end of the terminal housing 50 and the hooked end 104 of the catch, is then set at 0.122, ±0.002 inch. Thus, for a greatest catch surface of 0.120 inch and a least catch length of 0.120 inch, gap G will be zero. At the opposite extreme, for a least catch surface of 0.117 inch and a greatest catch length of 0.124 inch, gap G becomes 0.007 inch maximum.

Accordingly, the two catches 102 on the terminal housing 50, together with the latch 90 on the connector housing 12, act to secure the connector housing 12 to the sub-assembled terminal housing, wire board and lower cover so that the plug contact terminals 21 are held at a desired point of contact with the connector contact wires 18*a* to 18*h,* and the axis P of the connector housing is kept parallel to the wire board 14 during use.

While the foregoing description represents preferred embodiments of the invention, it will be obvious to those skilled in the art that various changes and modifications may be made, without departing from the spirit and scope of the invention pointed out by the following claims.

We claim:

1. A communication jack, comprising:

a jack housing including a front face with a plug opening having an axis for receiving a mating plug connector along the direction of said axis, a pair of side walls, a bottom wall, a rear wall, and a first catch protruding near the bottom wall of the jack housing;

a wire board having a front portion arranged to be inserted and supported in the jack housing so that a top surface of the front portion of the board is parallel to the axis of the jack housing;

a number of elongated contact wires supported by the wire board and extending over the front portion of the board, wherein the contact wires have connecting portions that establish electrical connections along a line of contact with corresponding contact terminals of the plug connector when the latter is received in the jack housing and the terminals of the plug connector wipe over the connecting portions of the contact wires in a direction parallel to the top surface of the board;

certain ones of the contact wires have crosstalk compensation sections that are located a determined distance from said line of contact;

a number of wire connection terminals projecting upward from a rear portion of the wire board and arranged to terminate outside wire leads;

a terminal housing mounted on the top surface and at the rear portion of the wire board for supporting the wire connection terminals at the rear portion of the wire board, wherein a front portion of the terminal housing adjoins the rear wall of the jack housing, and the terminal housing has one or more second catches disposed above the wire board and facing the jack housing;

a lower cover mounted on a lower surface and at the rear portion of the wire board, wherein the lower cover and the terminal housing are fixed to one another so that the rear portion of the board is captured and secured between the terminal housing and the lower cover, and a part of the lower cover is configured to engage the first catch near the bottom wall of the jack housing beneath the wire board; and a part of jack housing that adjoins the terminal housing is formed to engage the second catches on the terminal housing so that displacement of the crosstalk compensation sections of the contact wires with respect to said line of contact is restrained when an external force is applied tending to pivot the terminal housing in a direction away from the jack housing.

2. The communication jack of claim 1, wherein the second catches project from the front portion of the terminal housing, and the side walls of the jack housing have recesses dimensioned to receive and engage free ends of the second catches on the terminal housing.

3. The communication jack of claim 1, wherein the adjoining part of the jack housing and the second catches on the terminal housing are formed to define a separation gap between the rear wall of the jack housing and the front portion of the terminal housing of from zero to not more than about 0.007 inch when said external force is applied.

4. A communication jack according to claim 1, wherein the terminal housing has a fastening post with a tip that projects from a bottom surface of the housing, the wire board has an opening for passage of the fastening post, the lower cover has an opening that aligns with the tip of the fastening post on the terminal housing, and the tip of the fastening post of the terminal housing is fixed to the lower cover.

5. A communication jack according to claim 1, wherein the first catch on the jack housing is in the form of a slotted bar, and the lower cover has a lip dimensioned and arranged to engage the slotted bar.

* * * * *